US006398050B1

(12) United States Patent
Allora

(10) Patent No.: US 6,398,050 B1
(45) Date of Patent: Jun. 4, 2002

(54) LIQUID CONTAINER WITH OPPOSED OPENINGS AND AN END CAP FOR EACH OPENING, THE END CAPS ENGAGEABLE FOR STABILIZING THE CONTAINER ON A SMALLER END THEREOF

(76) Inventor: Vincent M. Allora, 215 Edwards La., Palm Beach Shores, FL (US) 33404

( * ) Notice: Subject to any disclaimer, the term of this patent is extended or adjusted under 35 U.S.C. 154(b) by 0 days.

(21) Appl. No.: 09/767,744

(22) Filed: Jan. 24, 2001

(51) Int. Cl.[7] ..... B65D 39/08

(52) U.S. Cl. ..... 215/228; 215/356; 215/DIG. 7; 215/376; 215/330; 215/331; 220/916; 220/212; 220/DIG. 19; 220/630; 220/711; 220/789; 222/482

(58) Field of Search ..... 215/DIG. 7, 2, 215/228, 356, 355, 376, 378, 377, 330, 331; 220/212, 916, 625, 630, 635, 636, DIG. 19, 789, 294, 711, 297, 703, 254–256; 222/482, 179.5; 248/688, 346, 346.01, 127; D9/436, 516; D7/511, 537; 217/110, 107, 106; 138/89, 96 T; 411/553, 549, 349, 551; 403/315, 317, 320, 316; 36/134, 67 D

(56) References Cited

U.S. PATENT DOCUMENTS

| | | | | | |
|---|---|---|---|---|---|
| 477,618 | A | * | 6/1892 | Becher | 222/482 X |
| 611,520 | A | | 9/1898 | Smith | |
| 1,370,665 | A | * | 3/1921 | Moore | 215/DIG. 7 X |
| 1,770,480 | A | | 7/1930 | Danciger | |
| 2,086,404 | A | * | 7/1937 | Daniels | 220/630 X |
| 2,990,080 | A | | 6/1961 | Harris | |
| 4,163,517 | A | | 8/1979 | Kappler et al. | |
| 4,289,248 | A | * | 9/1981 | Lynn | 215/330 |
| 4,349,116 | A | * | 9/1982 | Luenser | 215/330 |
| 4,618,066 | A | | 10/1986 | Vail | |
| 4,762,241 | A | | 8/1988 | Lang | |
| 5,141,136 | A | | 8/1992 | Tignor | |
| 5,474,206 | A | * | 12/1995 | Herring, Sr. | 220/636 |
| 5,829,607 | A | | 11/1998 | Ibrahim | |
| 5,885,332 | A | | 3/1999 | Gerner et al. | |
| D410,364 | S | | 6/1999 | Ramirez et al. | |
| 6,089,519 | A | * | 7/2000 | Laybourne | 220/212 X |
| 6,164,473 | A | * | 12/2000 | Waldrip | 215/378 |
| 6,261,042 | B1 | * | 7/2001 | Pratt | 411/551 |

FOREIGN PATENT DOCUMENTS

| | | |
|---|---|---|
| DE | 74261 | 4/1894 |
| DE | 3921971 | 1/1991 |
| DE | 4109886 | 10/1992 |

* cited by examiner

*Primary Examiner*—Lee Young
*Assistant Examiner*—Robin A. Hylton
(74) *Attorney, Agent, or Firm*—Richard C. Litman

(57) ABSTRACT

A liquid container with opposed openings has a smaller neck and larger base, with correspondingly sized openings and caps. The base cap includes a receptacle, for installing over the cap of the smaller diameter container end. The smaller diameter cap includes an outwardly extending non-circular flange, which engages the correspondingly shaped receptacle in the larger base end cap. The base cap receptacle also has a circular second, innermost area. The base cap receptacle is aligned with the flange of the smaller diameter cap and rotated ninety degrees, to misalign the two non-circular shapes and lock the smaller diameter cap flange within then innermost portion of the base cap receptacle. This permits the container to be inverted with the smaller diameter end downward, the larger diameter cap to be removed and installed on the now lowermost smaller diameter cap, and the contents dispensed from the uppermost larger diameter end.

15 Claims, 4 Drawing Sheets

LIQUID CONTAINER WITH OPPOSED OPENINGS AND AN END CAP FOR EACH OPENING, THE END CAPS ENGAGEABLE FOR STABILIZING THE CONTAINER ON A SMALLER END THEREOF

BACKGROUND OF THE INVENTION

1. Field of the Invention

The present invention relates generally to closable and sealable containers for liquids, and more particularly to a liquid container particularly adapted (but not limited) for use as a beverage container. The present container is preferably configured in the form of a bottle having a relatively narrow neck and openable closure at one end, with a wider base and openable closure at the opposite base end. Means are provided for inverting the bottle with the narrow end down, removing the closure from the now upturned wider end, and locking it onto the narrow end closure to provide a stable support for the inverted bottle.

2. Description of the Related Art

The bottle having a relatively narrow neck and wider base has been proven to be a popular and practical shape for serving as a liquid container. The relatively narrow neck provides a small opening which is easily closed and from which liquids (at least those of low viscosity) may be readily poured. The small mouth of such bottles also makes a convenient drinking dispenser for beverages consumed directly from the bottle, with the mouth of the consumer generally closely fitting the mouth of the bottle to preclude spillage.

However, such bottles with their relatively narrow openings also have certain drawbacks. For example, in many cases it is desirable to drink a beverage from a more conventional glass having a wide opening at its upper end. There may be practical considerations for such a container configuration, e.g., allowing the liquid to "breathe" before or during consumption, as well as esthetic reasons.

Another important practical point is that hot beverages are difficult, and potentially hazardous, to consume from a narrow necked bottle. The development of microwave technology for heating foods and beverages has made it easy to heat a liquid within a bottle without overheating the container itself. However, it is very difficult, if not impossible, to sip a liquid from such a narrow necked opening and to avoid ingesting too large a quantity at any one time, which would result in burning the mouth of the consumer. Traditionally, hot beverages are taken from containers having wide openings (cups, glasses, etc.) which permit the consumer to sip the hot beverage slowly to avoid burning the mouth.

Another characteristic of narrow necked bottles and containers is their reluctance to pour relatively viscous liquids (e.g., ketchup, etc.). While it may be possible to pour the desired quantity from a nearly full bottle, it becomes considerably more difficult as the contents are depleted from the bottle, particularly if the bottle has been-stored in an upright position. A wider opening for the container would greatly facilitate access to the remaining contents of such a viscous liquid.

Accordingly, a need will be seen for a liquid container with opposed openings, with the container having a relatively wide end and an opposite relatively narrow end. Each end includes an openable closure, so the contents of the bottle may be accessed from either the wide or narrow end of the container, as desired. The wider closure may be removed from its corresponding container end and locked to the closure of the narrow end, thus providing a relatively wide support base for the container in its inverted orientation with the narrow neck end positioned downwardly. This allows a consumer to drink from the wider opening of the bottle, while providing good support for the bottle to hold the wider opening upwards as desired.

A discussion of the related art of which the present inventor is aware, and its differences and distinctions from the present invention, is provided below.

U.S. Pat. No. 611,520 issued on Sep. 27, 1898 to Charles S. Smith, titled "Bottle For Holding Spirits Or Other Liquids And Aerated Waters Separated Until Bottle Is Opened," describes a bottle having opposite interconnected compartments therein. A stopper is placed between the two, from the larger chamber. The larger chamber is then filled with a liquid under pressure (e.g., seltzer water) to hold the internal stopper in place, the larger chamber is sealed, and the smaller chamber is filled with a liquid (distilled liquor, etc.) and sealed. Removal of the stopper from the larger chamber releases the pressure therein, allowing the intermediate stopper to fall free and the two liquids to mix together. From the above, it is clear that the Smith bottle is intended for only a single use, as any remaining mixture of the liquids would not retain the original carbonated character For long after pressure release. While the present double ended bottle may be used as a single serving container, the two opposite closures also provide for resealing the bottle as desired. Moreover, the two opposed closures cannot be connected to one another, to support the bottle in an inverted orientation with the narrow neck disposed downwardly, as in the case of the present invention. In any case, there is no motivation for holding the Smith bottle in an inverted position, as the bottom opening is relatively small and centered in the wider base, thus making it extremely difficult to drink from that opening anyway.

U.S. Pat. No. 1,770,480 issued on Jul. 15, 1930 to Abraham Danciger, titled "Beverage Container," describes a bottle having an opening at both ends thereof. One opening is configured for a conventional crimped metal cap, while the opposite opening requires a different type of seal due to the need to pass a stopper therethrough and into the bottle interior. The Danciger bottle and closure assembly is intended to capture sediment at one end of the bottle, as may occur during fermentation, and capture the sediment in the smaller neck of the bottle behind the stopper. The elongate wire rod which passes through the larger seal for manipulating the stopper, precludes use of the larger closure as a base for the bottle regardless of which end it is placed upon. This also precludes installation of the larger closure on the smaller closure U.S. Pat. No. 2,990,080 issued on Jun. 27, 1961 to Melvin A. Harris, titled "Inverted Bottle Support," describes a device for supporting a conventional bottle, either upright or inverted. The device comprises a relatively wide circular plate with a central socket for receiving a specially configured stopper end. The stopper end fits closely within the plate receptacle, so the bottle may be held in an inverted position resting upon the support plate. However, the bottle is conventional, having a closed larger base end. The Harris components are configured to support a conventional bottle either upright or inverted, and no bottle having opposed open ends is disclosed.

U.S. Pat. No. 4,163,517 issued on Aug. 7, 1979 to Hermann Kappler et al., titled "Tubular Container," describes a container having ends of equal diameter with closures at each end. However, only one of the end closures of the Kappler et al. device is openable after manufacture. One of the ends is provided with a series of circumferential barbs or ribs, which engage the inner wall of the cylinder to secure this end cap permanently to the cylinder; only the opposite end is openable after manufacture. This is expected, as both ends are the same diameter, and thus there is no need to provide a removable cap or cover at each end, as provided by the present invention with its bottle ends of different diameters. Moreover, Kappler et al. do not provide any means for attaching the removable cap or cover to the opposite end of the container, as provided by the present invention.

U.S. Pat. No. 4,618,066 issued on Oct. 21, 1986 to John G. Vail, titled "Combined Insulated Drinking Mug And Megaphone," describes a device having a tubular, frusto-conical shape with removable closures at, each end thereof. The device may be used to contain a liquid when both closures are installed, or to drink from when the smaller end cap is removed. Removal of both end closures allows the device to be used as a megaphone. However, the larger end cap or closure does not attach to the smaller cap in any way. While Vail notes that the double walled lower cap may be opened for placement of small articles therein, it is noted that the thickness of the larger cap is insufficient to place the smaller cap therein, as is clearly shown in FIG. 4 of the Vail U.S. Patent. In addition, the smaller diameter cap has a rounded, convex outer surface, precluding its use as a resting surface for the assembly. Thus, the only way the device may be stably placed, is upon its larger end.

U.S. Pat. No. 4,762,241 issued on Aug. 9, 1988 to Richard R. Lang, titled "Container with Supplemental Opening For Extracting Contents," describes a liquid container having a wide base and narrow neck, with a small opening in or near the base. The Lang container allows the last of a liquid substance to be drained therefrom without inverting the container, by means of the base opening. Lang does not disclose any means of locking the two closures together, and he teaches away from the inversion of the bottle or container, which inversion is permitted by the novel configuration of the closures of the present invention.

U.S. Pat. No. 5,141,136 issued on Aug. 25, 1992 to Jeffrey H. Tignor, titled "Dual Opening Squeeze Bottle," describes a bottle formed of a flexible plastic material with a relatively small central bottom opening therein. The function of the Tignor bottle is essentially the same as that of the Lang containers discussed immediately above, i.e., to drain the last of a viscous substance from the container without need to invert the container. Tignor accomplishes this by sealing the top of the container and applying pressure to the flexible sides of the bottle, to distend the bottom with its central opening. The cap of the central bottom opening is then removed to drain the material from the bottle. Thus, there is no motivation for Tignor to provide any means for resting his bottle in a stable position upon its normally upper end, as provided by the present invention. Moreover, Tignor does not disclose any means of attaching one closure to the other.

U.S. Pat. No. 5,829,607 issued on Nov. 3, 1998 to Moheb M. Ibrahim, titled "Double Ended Bottle," describes a container providing essentially the same function as the devices of the Lang '241 and Tignor '136 U.S. Patents discussed above, i.e., to drain the last of a viscous substance therefrom. The Ibrahim container is longitudinally symmetrical, having identically sized openings at each end. Identical caps are provided at each end, with the caps being substantially the same diameter as the bottle, and as one another. Thus, it is not possible to secure one cap to its identically configured opposite with the Tignor bottle, as is possible with the present double ended container invention.

U.S. Pat. No. 5,885,332 issued on Mar. 23, 1999 to Yuri Gerner et al., titled "Solvent Receptacle And Degasser For Use In High Pressure Liquid Chromatography," describes an apparatus utilizing a double ended bottle for the solvent reservoir. The bottle appears to be longitudinally symmetrical, with apparently identically configured openings at each end. The lower end of the bottle threads into a fitting which communicates with the fixed vacuum degassing apparatus, while the upper end provides for the attachment of another fitting for delivering recycled fluids back to the bottle. Neither of the fittings may be secured together, which provision is a part of the present invention. Moreover, the fixed configuration of the lower fitting requires that the open lower end of the bottle be secured thereto, as the bottle cannot be inverted with the lower fitting attached.

U.S. Pat. No. D-410,364 issued on Jun. 1, 1999 to Frankie Ramirez et al., titled "Convertible Travel Cup And Bottle," illustrates a design for a pair of mating container components, with one selectively nesting within the other for storage. The second component may be removed, inverted, and reattached to the first component to form a container having a closed bottom end. However, the upper end includes a "sip" passage and a vent hole, in the manner of travel cups and the like, with no apparent means for closing the two passages. The Ramirez et al. design thus could not be inverted, as the lack of closure for the first component would spill the contents. Moreover, only the two cap components are shown; no intervening bottle or other container is provided.

German Patent Publication No. 74,261 published on Apr. 5, 1894 illustrates a bottle and cup assembly. The bottle appears to have an externally threaded neck, with the cup having an internally threaded base for securing to the neck of the bottle. The cup thus provides a closure for the bottle, and when removed, provides a container from which a liquid may be consumed. While the cup includes a relatively wide base, and might be used to support the bottle in an inverted position, there is no motivation for such a configuration since there is no opening in the base of the bottle.

German Patent Publication No. 3,921,971 published on Jan. 17, 1991 describes (according to the English abstract and drawings) a bottle for inverted suspension within a refrigerator. The bottle has a relatively larger base and small neck, with the neck disposed downwardly for dispensing a liquid therefrom. The smaller, lower cap is plunger actuated for dispensing the liquid therethrough, rather than being closed, as in the present caps. The larger cap is normally disposed atop the wider end of the bottle, but may be removed therefrom and placed beneath the spout of the smaller lower cap to support the bottle thereon. In this configuration, the upper end of the bottle is open for filling. This device differs from the present invention in that the smaller dispensing cap has a passage therethrough and is adapted for dispensing liquids therefrom in an inverted position, whereas the smaller cap of the present bottle is closed and cannot pass liquid therethrough. This is a critical point, as the smaller cap of the '971 German Patent Publication cannot be positively sealed to the bottle, as can the threaded cap of the present bottle invention. Moreover, the externally threaded neck of the '971 German bottle is adequate for attaching the surrounding collar of the cap thereto, but does not provide a good contact surface for drinking therefrom. There is no motivation for the '971 German bottle to provide an internally threaded neck, as it is not intended that the bottle be drunk from directly, whereas the present bottle is intended for such use. Also, the spout of the smaller cap of the '971 German bottle merely nests in a socket in the larger cap when the larger cap is removed and placed thereunder, rather than being positively locked in place, as in the present double ended bottle. This is an important point, as when the bottle in this configuration is lifted from the underlying surface, the larger cap will remain behind, as it is not positively attached to the smaller cap. The present bottle invention provides positive attachment means for all components.

Finally, German Patent Publication No. 4,109,886 published on Oct. 1, 1992 describes (according to the English abstract and drawings) several embodiments of a truncated conical container with one end being permanently sealed. The drawings show the larger and the smaller diameter ends being either permanently closed or open, in various embodiments. Various means are provided for attaching the larger diameter cap or closure to the smaller diameter end, but there is no means of securing the smaller cap to the larger one, as the two caps are not provided simultaneously in any one embodiment.

None of the above inventions and patents, either singly or in combination, is seen to describe the instant invention as claimed.

SUMMARY OF THE INVENTION

The present invention comprises a liquid container or bottle having opposite ends of unequal diameter, with each end being open. Each end includes a threaded cap or closure therefor, with the bottle ends being internally threaded to provide a smooth contact surface for drinking from the bottle; the mating closures are externally threaded. The larger diameter closure includes a central socket adapted for positively locking to a flange extending from the smaller diameter cap or closure. This configuration allows the smaller cap to be removed from the neck of the bottle and fluid poured or consumed therefrom, as is conventional in bottles having relatively narrow necks. However, the bottle may be inverted with the smaller cap positioned downwardly and the larger diameter disposed upwardly. In this orientation, the larger diameter cap or closure may be removed, with the larger diameter opening allowing a person to drink therefrom as when drinking from a cup, water glass, or the like. The larger diameter closure may be positively locked to the flange of the smaller diameter closure to serve as a wide and stable base for the assembly, if so desired, when the narrow neck of the bottle is positioned downwardly.

Accordingly, it is a principal object of the invention to provide a liquid container having a relatively small diameter openable end and an opposite, relatively large diameter openable end, for consuming or dispensing liquid from either end of the container as desired.

It is another object of the invention to provide externally threaded, liquid impervious closures or caps for each end of the container, with each end of the container having corresponding mating internal threads, for providing a smooth external contact surface for drinking directly from the container.

It is a further object of the invention to provide a liquid container having a larger diameter closure which includes a central receptacle therein for securing to the smaller diameter closure as desired, thereby allowing the assembly to be inverted for use as a drinking glass with the smaller diameter neck of the container disposed downwardly, the interlocked closures providing a large diameter, stable base for the assembly.

Still another object of the invention is to provide means for positively locking and securing the larger diameter closure or cap to the smaller diameter closure or cap, thus assuring retention of the larger diameter cap to the remainder of the assembly when the larger diameter cap is secured to the smaller diameter cap and the assembly is lifted.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a liquid container (e.g., beverage bottle, etc.) having resealable openings at opposite ends thereof. The two caps or closures for the ends may be secured together, with the larger diameter cap secured to the smaller diameter cap. This permits the larger diameter cap to serve as a base for the assembly, with the smaller diameter portion or neck of the bottle or container oriented below the larger diameter portion for drinking or dispensing a beverage or liquid therefrom.

Figure 1:
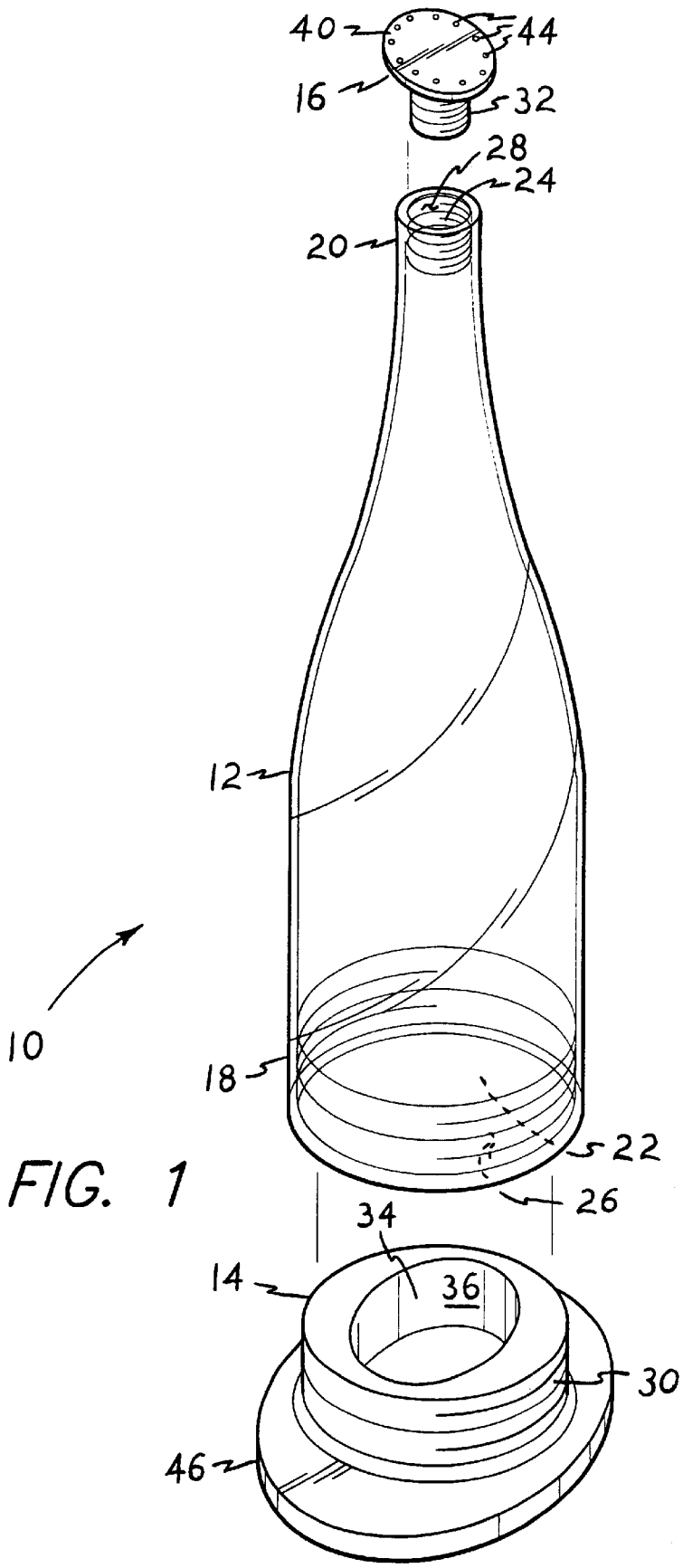
FIG. 1 is an exploded perspective view of a liquid container with opposed openings according to the present invention, showing the smaller and larger diameter caps or closures slightly removed from the container.

FIG. 1 provides an exploded perspective view of the present container assembly 10, comprising a bottle-shaped container 12 with its two opposed end caps 14 and 16. The bottle 12 has a relatively large diameter first end 18, with an opposite smaller diameter second end 20. The larger diameter first end 18 has a correspondingly large diameter opening 22 therethrough, spanning substantially the diameter of the bottle 12. The smaller diameter second or neck end 20 also includes a correspondingly smaller diameter opening 24 therethrough, substantially the diameter of the smaller end 18 of the bottle 12. Each of the openings 22 and 24 includes internal threads, respectively 26 and 28, formed therein to provide a smooth and unbroken external mouth contact surface for the bottle 12, for drinking a beverage therefrom.

The two caps 14 and 16 are each liquid impervious and devoid of openings therethrough, with each including external threads thereon, respectively 30 and 32. These threaded cap portions 30 and 32 mate closely with the respective internal threads 26 and 28 of the bottle or container ends 18 and 20, to provide a liquid proof seal when firmly secured to the bottle 12. The threaded ends of the bottle 12 and caps 14, 16 allow the bottle 12 to be resealed, if so desired. While the present double ended container 10 may be provided in individual serving sizes, it will be seen that there are no specific limitations as to the size of the container to which the present invention may be applied, and thus it may be desirable at times to reseal the container after some beverage or other liquid has been dispensed therefrom.

The present double ended opening container invention also includes means for positively locking the two caps 14 and 16 together, as desired. The larger diameter first end cap 14 has a receptacle 34 in the center thereof, with a relatively deep, non-circular opening or lip 36. The cap receptacle 34 also includes a circular internal slot 38 therein, beneath the non-circular opening or lip 36, shown most clearly in FIGS. 2 through 4 of the drawings. The smaller diameter second end cap 16 includes a non-circular flange 40 extending therefrom, with the flange 40 being configured to fit closely within the corresponding non-circular opening 36 of the first end cap receptacle 34. The non-circular shapes of the first end cap receptacle opening 36 and the second end cap flange 40 are illustrated in the drawing Figures as being elliptical with essentially the same major and minor axes, but it will be seen that any substantially congruent non-circular shapes (e.g., square, rectangular, triangular, irregular non-geometric, etc.) may be used to achieve the same result, as described below.

The mating shapes of the first end cap receptacle 38 and the second end cap flange 40, provides means for positively, yet removably, locking the larger first end cap 14 onto the second end cap 16, as desired. This allows the present double ended container assembly 10 to be inverted, with the narrower second or neck end 20 oriented at the bottom of the container, while providing secure support for the assembly by means of the larger diameter first end cap 14 being positively secured to the smaller diameter second end cap 16 which is in turn sealingly secured to the container neck 20.

Figure 2:
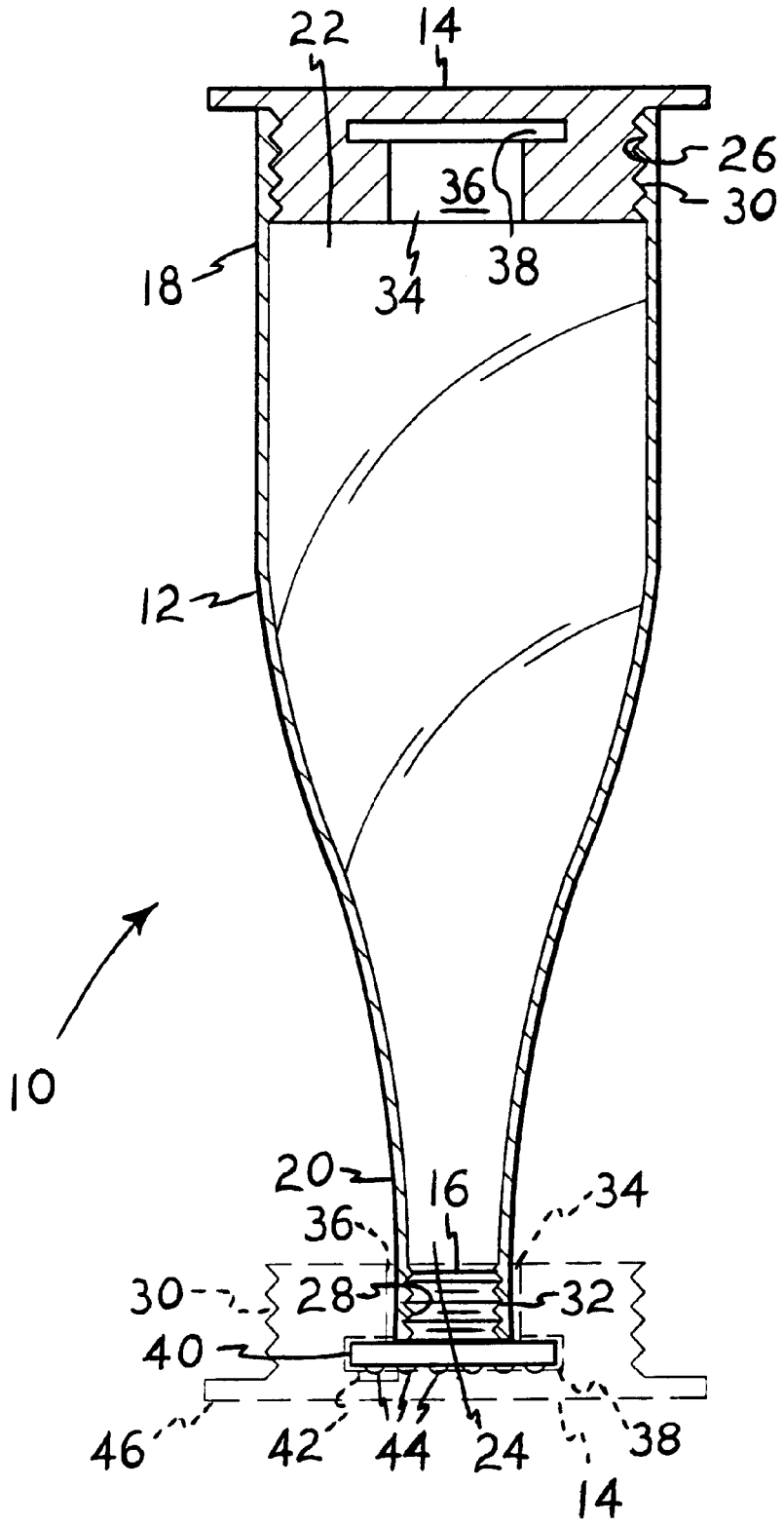
FIG. 2 is an elevational view of the present container, showing its inversion for positioning the larger diameter at the top, with the support means provided by the larger diameter cap being shown in broken lines.
Figure 3:
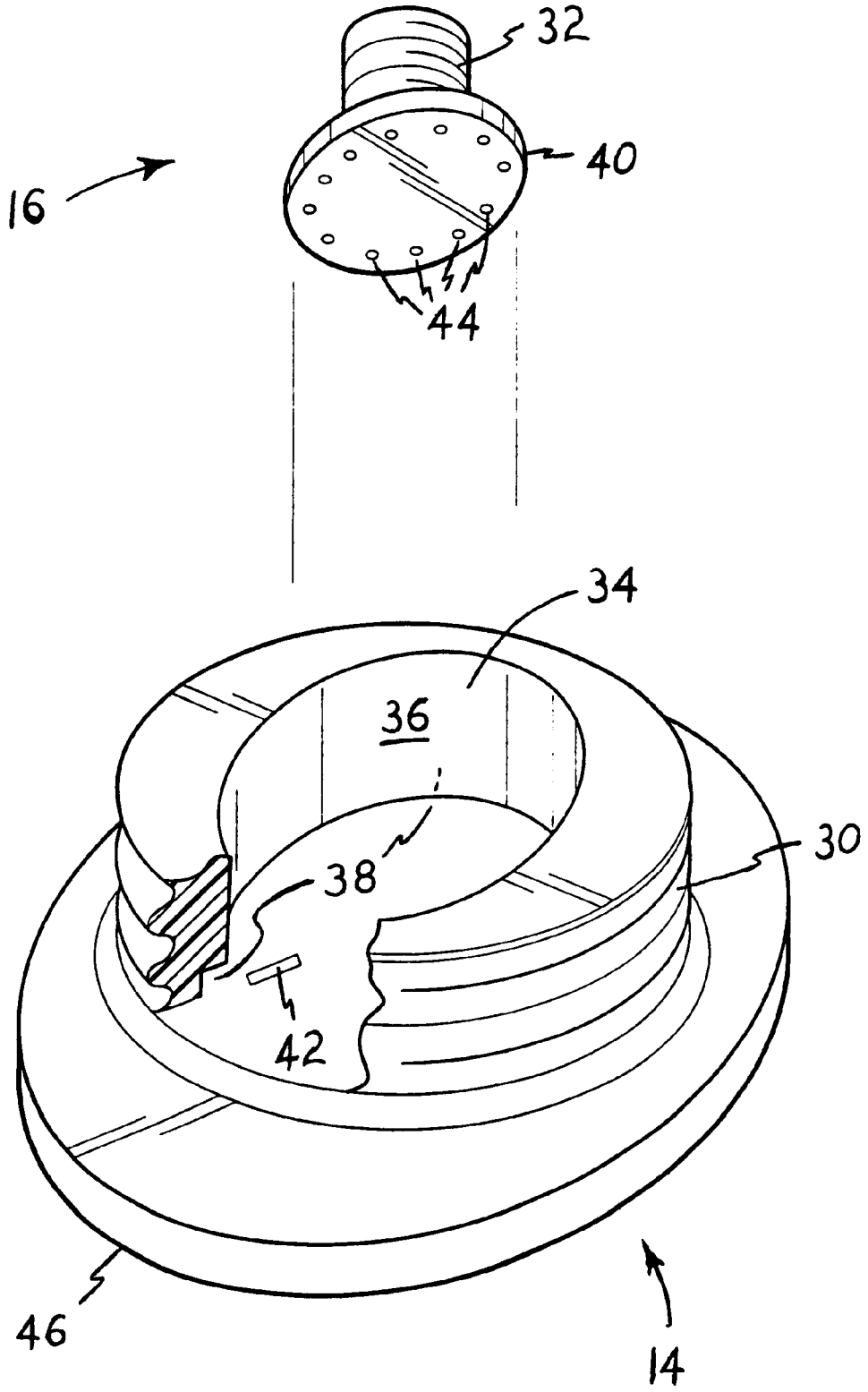
FIG. 3 is an exploded perspective view of the two caps or closures with a portion of the larger diameter cap broken away, showing the means for positively locking the two caps together.
Figure 4:
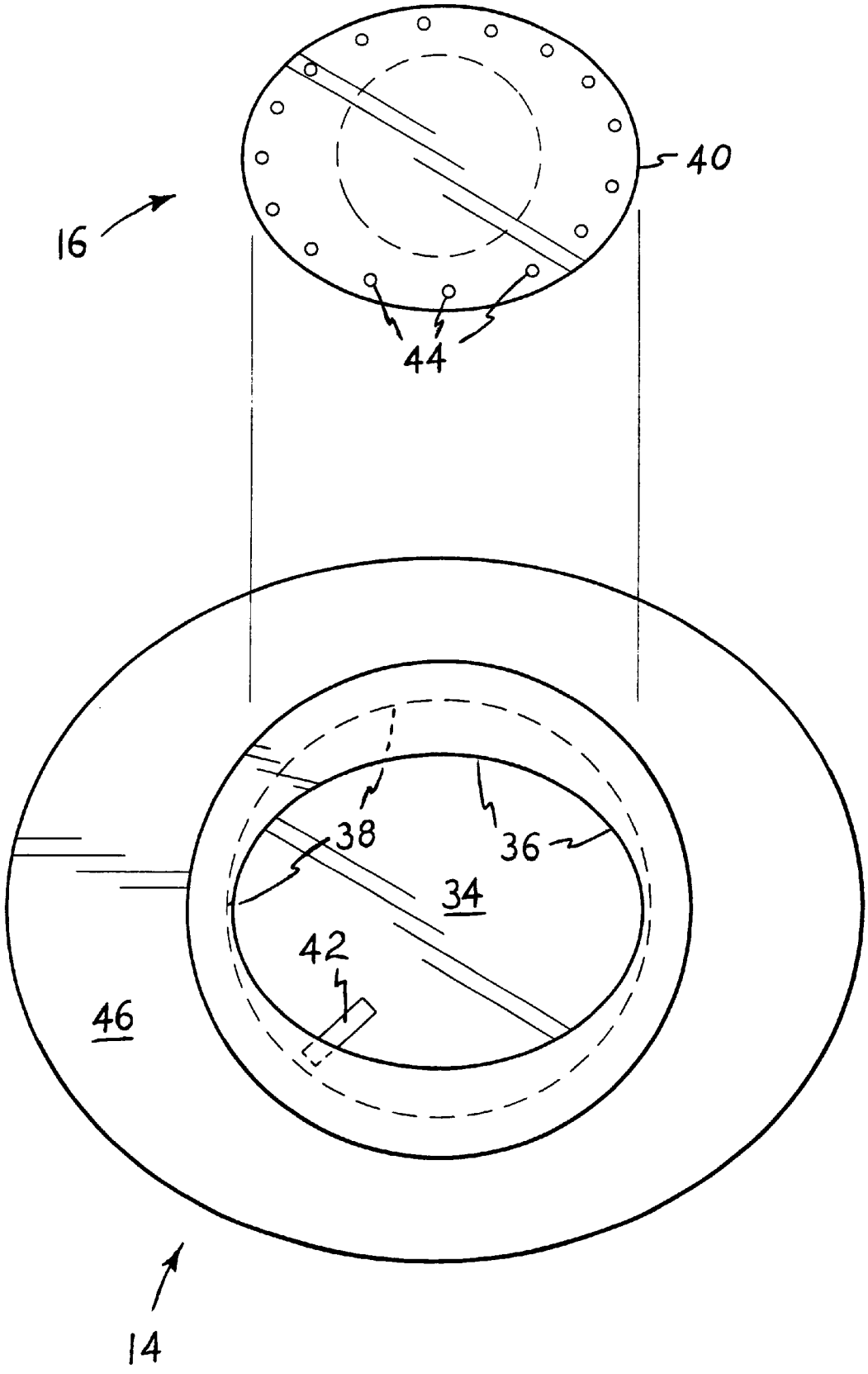
FIG. 4 is an exploded top perspective view of the two closures or caps, further illustrating their assembly to one another.

FIG. 2 illustrates the inversion of the bottle or container assembly 10, with the larger diameter cap 14 being shown in broken lines for supporting the assembly with the larger diameter first end 18 of the bottle 12 oriented upwardly. FIGS. 3 and 4 respectively provide exploded perspective views of the two end caps or closures 14 and 16, showing more clearly how these components fit together. (The smaller diameter cap 16 is shown to a smaller scale than the larger diameter cap 14, in FIG. 3. It will be understood that the major and minor diameters of the respective elliptical shapes of the receptacle opening 36 of the larger diameter cap 14 and the flange 40 of the smaller diameter cap 16, are essentially equal, excepting some difference for ease of fit and tolerances.)

The bottle assembly 10 is first inverted, as shown in FIG. 2, with the larger diameter first end oriented upwardly and the smaller diameter second end positioned downwardly. Any liquid within the bottle 12, will thus drain away from the now uppermost larger diameter first end cap or plug 14. This first end cap 14 is removed from the bottle 12, inverted to position the receptacle 34 facing upwardly, and the flange 40 of the second end cap 16 is inserted into the upwardly facing receptacle 34 of the larger diameter second end cap 14. It will be seen that the flange 40 of the second end cap 16 will only fit into the opening 36 of the first end cap receptacle 34 in one orientation, due to the closely congruent configurations of the opening 36 and flange 40 and their non-circular configurations.

However, once the second cap flange 40 has been inserted completely past the non-circular opening area 36 of the first cap receptacle 34, it resides within the internal circular slot area 38 of the receptacle 34. This allows the second cap flange 40 to be rotated essentially ninety degrees to misalign the major and minor axes of the two elliptical shapes 36 and 40, with the lobes of the flange 40 major axis captured beneath the sides of the receptacle opening 36 minor axis to lock the larger first end cap 14 to the second end cap 16, and thus to the container 12 as well. Thus, when the container assembly 10 is lifted for drinking or dispensing a beverage or other liquid from the now upwardly oriented larger diameter opening 22, the lowermost larger diameter cap 14 remains attached to the assembly and cannot be separated therefrom or lost.

Additional security for the first and second cap assembly is provided by a slot 42 formed in the floor of the receptacle slot 38 of the first end cap 14, with a series of mating protuberances 44 projecting from the flange 40 of the second end cap 16. These protuberances 44 will be compressed slightly as they bear against the inner surface of the receptacle slot 40, due to the slightly resilient nature of the plastic material preferably used for the cap components 14 and 16. However, one of the protuberances 44 of the flange 40 will periodically engage the slot 42 of the receptacle slot 38, and resist further rotation past that point. While a slight amount of rotational force is sufficient to turn the two caps 14 and 16 relative to one another, this arrangement precludes inadvertent relative rotation of the two components.

It will be seen that other means for precluding relative rotation of the two cap components 14 and 16 may be provided, as desired. For example, the above described slot 42 and protuberances 44 may be reversed, with a single protuberance alternately engaging one of a series of slots. Alternatively, the rotational resistance means could be provided along the periphery of the circular inner slot 38 of the first cap receptacle 34 and corresponding or mating means provided at the ends of the major axis or diameter of the second cap flange 40, with the two means (resilient teeth, etc.) engaging one another to prevent inadvertent relative rotation of the two components.

The above described assembly, with the narrower second or neck end 20 of the bottle 10 oriented downwardly as shown in FIG. 2 of the drawings, is provided with stability by means of the flat external surface of the larger diameter first cap 14. Additional stability may be provided by means of a larger diameter flange 46 extending from the larger first end cap 14, if so desired. If such a support flange 46 is provided, it may be configured to have the same geometric shape but with a larger diameter or size, i.e., be geometrically similar, but not congruent, to the shape of the flange 40 of the smaller diameter second end cap 16 and the corresponding receptacle opening 36 of the larger diameter first end cap 14 and may have the same orientation as the receptacle opening, in order to remind the user of the orientation of the flange 40 and opening 36 when securing or removing the first end cap 14 from the second end cap 16.

In conclusion, the present liquid container with its opposed openings of different diameters, provides a versatile means of presenting a beverage from a container having two different configurations, yet achieving this with a single container. Where it is desired to drink or dispense the beverage or liquid from the narrower mouth of the container, the user may simply remove the smaller diameter cap and drink from the smaller mouth of the bottle or dispense the liquid as desired. However, in many circumstances, a wider mouth container is desirable for esthetic or other reasons. For example, it may be hazardous to consume a very hot beverage from a container having a narrow outlet, as it is very difficult to sip very small quantities of the beverage from such a container. A substantial potential hazard exists in such a circumstance, that the consumer may inadvertently ingest a larger quantity of the hot liquid than desired, and burn the interior of his or her mouth.

The present double ended container responds to this need as described above, merely by inverting the bottle with its narrow neck end downward, removing the larger diameter cap from the now upwardly disposed first end, and securing it to the second end cap as described further above. The positive locking means of the two caps, assures that the first cap cannot inadvertently fall from the second cap. Also, the provision of the first cap receptacle to the inside surface of the first cap, assures that the receptacle will not become contaminated before use or by resting upon a soiled surface, and possibly contaminate the remaining beverage within the container if it is reattached to its first open end.

The present container may be made in sizes capable of holding more than a single beverage serving, if so desired, as noted above. However, it is envisioned that the present invention is particularly suitable for individual serving quantities. Accordingly, other means of securing the two caps to the ends of the container may be used as desired, e.g., crimping, etc., rather than the reusable threaded means described herein. It should also be noted that other alternatives are perfectly possible with the present invention, such as differently shaped bottles or containers (square or rectangular cross sections, shorter or longer aspect ratios, etc.), and that the containers may be formed of any practicable transparent, translucent, or opaque material (glass, plastic, thin formed sheet metal, etc.), as desired. Regardless of the materials and geometric shapes used, the present container with its opposed openings will provide an extremely versatile means of serving a beverage, or dispensing other liquids, which means has not been previously available to the consumer.

It is to be understood that the present invention is not limited to the embodiment described above, but encompasses any and all embodiments within the scope of the following claims.

I claim:

1. A liquid container with opposed openings, comprising:

a bottle having a large diameter first end and a small diameter second end opposite said first end;

said first end including a large diameter first opening therein, and said second end including a small diameter second opening therein;

a large diameter first end cap for removably sealing said first opening, and a small diameter second end cap for removably sealing said second opening; and means for removably and positively locking said large diameter first end cap to said small diameter second end cap, for supporting said bottle with said small diameter second end disposed downwardly and resting upon said large diameter first end cap;

wherein said means for positively locking said larger diameter first end cap onto said smaller diameter second end cap comprises:

said larger diameter first end cap having a receptacle formed therein;

said receptacle comprising a non-circular opening with a circular internal slot;

said smaller diameter second end cap including a non-circular flange extending therefrom;

said non-circular opening of said first end cap receptacle fitting closely about said non-circular flange of said second end cap, for placing said first end cap receptacle over said flange of said second end cap, turning said first end cap to misalign said non-circular opening of said first end cap receptacle relative to said non-circular flange of said second end cap, and locking said flange of said second end cap within said circular internal slot and beneath said non-circular opening of said first end cap receptacle.

2. The liquid container according to claim 1, including means for precluding inadvertent rotation of said first end cap relative to said second end cap, when said first end cap is installed upon said second end cap.

3. The liquid container according to claim 1, wherein said non-circular opening of said first end cap receptacle and said non-circular flange of said second end cap are elliptically shaped.

4. The liquid container according to claim 1, wherein said first end cap includes a large non-circular flange extending therefrom and shaped similarly to said non-circular opening of said first end cap receptacle and to said non-circular flange of said second end cap.

5. The liquid container according to claim 1, wherein each said cap is liquid impervious and devoid of passages therethrough.

6. The liquid container according to claim 1, wherein:

said first end and said second end of said bottle are each threaded internally; and said first end cap and said second end cap are each threaded externally, for removably attaching respectively to said first end and to said second end of said bottle.

7. A liquid container with opposed openings, comprising:

a bottle having a large diameter first end and a small diameter second end opposite said first end;

said first end including a large diameter first opening therein, and said second end including a small diameter second opening therein;

a liquid impervious large diameter first end cap for removably sealing said first opening, and a liquid impervious small diameter second end cap for removably sealing said second opening;

said large diameter first end cap removably fitting onto said small diameter second end cap, for supporting said bottle with said small diameter second end disposed downwardly and resting upon said large diameter first end cap; and means for positively locking said larger diameter first end cap onto said smaller diameter second end cap;

said means for positively locking said larger diameter first end cap onto said smaller diameter second end cap comprises:

said larger diameter first end cap having a receptacle formed therein;

said receptacle comprising a non-circular opening with a circular internal slot;

said smaller diameter second end cap including a non-circular flange extending therefrom;

said non-circular opening of said first end cap receptacle fitting closely about said non-circular flange of said second end cap, for placing said first end cap receptacle over said flange of said second end cap, turning said first end cap to misalign said non-circular opening of said first end cap receptacle relative to said non-circular flange of said second end cap, and locking said flange of said second end cap within said circular internal slot and beneath said non-circular opening of said first end cap receptacle.

8. The liquid container according to claim 7, including means for precluding inadvertent rotation of said first end cap relative to said second end cap, when said first end cap is installed upon said second end cap.

9. The liquid container according to claim 7, wherein said non-circular opening of said first end cap receptacle and said non-circular flange of said second end cap are elliptically shaped.

10. The liquid container according to claim 7, wherein said first end cap includes a large non-circular flange extending therefrom and shaped similarly to said non-circular opening of said first end cap receptacle and to said non-circular flange of said second end cap.

11. The liquid container according to claim 7, wherein:

said first end and said second end of said bottle are each threaded internally; and said first end cap and said second end cap are each threaded externally, for removably attaching respectively to said first end and to said second end of said bottle.

12. A liquid container with opposed openings, comprising:

a bottle having a large diameter first end and a small diameter second end opposite said first end;

said first end including a large diameter, internally threaded first opening therein, and said second end including a small diameter, internally threaded second opening therein;

a large diameter, externally threaded first end cap for removably sealing said first opening, and a small diameter, externally threaded second end cap for removably sealing said second opening;

said large diameter first end cap removably fitting onto said small diameter second end cap, for supporting said bottle with said small diameter second end disposed downwardly and resting upon said large diameter first end cap; and means for positively locking said larger diameter first end cap onto said smaller diameter second end cap;

said means for positively locking said larger diameter first end cap onto said smaller diameter second end cap comprises:

said larger diameter first end cap having a receptacle formed therein;

said receptacle comprising a non-circular opening with a circular internal slot;

said smaller diameter second end cap including a non-circular flange extending therefrom;

said non-circular opening of said first end cap receptacle fitting closely about said non-circular flange of said second end cap, for placing said first end cap receptacle over said flange of said second end cap, turning said first end cap to misalign said non-circular opening of said first end cap receptacle relative to said non-circular flange of said second end cap, and locking said flange of said second end cap within said circular internal slot and beneath said non-circular opening of said first end cap receptacle.

13. The liquid container according to claim 12, including means for precluding inadvertent rotation of said first end cap relative to said second end cap, when said first end cap is installed upon said second end cap.

14. The liquid container according to claim 12, wherein:

said non-circular opening of said first end cap receptacle and said non-circular flange of said second end cap are elliptically shaped; and first end cap includes a large non-circular flange extending therefrom and shaped similarly to said non-circular opening of said first end cap receptacle and to said non-circular flange of said second end cap.

15. The liquid container according to claim 12, wherein each said cap is liquid impervious and devoid of passages therethrough.

* * * * *